United States Patent [19]

Kishimoto et al.

[11] Patent Number: 4,524,129

[45] Date of Patent: Jun. 18, 1985

[54] METHOD FOR PROCESSING COLOR PHOTOGRAPHIC LIGHT-SENSITIVE MATERIAL

[75] Inventors: Shinzo Kishimoto; Shigeru Ohno, both of Kanagawa; Teruaki Tsujikawa, Shiga, all of Japan

[73] Assignee: Fuji Photo Film Co., Ltd., Kanagawa, Japan

[21] Appl. No.: 651,150

[22] Filed: Sep. 17, 1984

[30] Foreign Application Priority Data

Sep. 16, 1983 [JP] Japan ..... 58-170976

[51] Int. Cl.[3] ..... G03C 7/00

[52] U.S. Cl. ..... 430/393; 430/429; 430/430; 430/445; 430/455; 430/460; 430/461

[58] Field of Search ..... 430/393, 429, 430, 445, 430/455, 460, 461

[56] References Cited

U.S. PATENT DOCUMENTS

| | | | |
|---|---|---|---|
| 2,432,506 | 12/1946 | Chilton et al. | 430/429 |
| 4,163,669 | 8/1979 | Kanada et al. | 430/418 |
| 4,292,401 | 9/1981 | Itoh et al. | 430/430 |
| 4,293,639 | 10/1981 | Itoh et al. | 430/461 |
| 4,301,236 | 11/1981 | Idota et al. | 430/393 |
| 4,322,493 | 3/1982 | Shibaoka et al. | 430/461 |
| 4,458,010 | 7/1984 | Yamamuro et al. | 430/393 |
| 4,481,290 | 11/1984 | Kishimoto et al. | 430/393 |

FOREIGN PATENT DOCUMENTS

| | | | |
|---|---|---|---|
| 1138842 | 1/1969 | United Kingdom | 430/393 |

*Primary Examiner*—J. Travis Brown

*Attorney, Agent, or Firm*—Sughrue, Mion, Zinn Macpeak & Seas

[57] ABSTRACT

A method for processing a color photographic light-sensitive material by subjecting an exposed silver halide color photographic light-sensitive material to color development processing then to bleaching processing and fixing processing or to bleach-fixing processing, which process comprises using a ferric ion complex salt or a persulfate as a bleaching agent in the bleaching processing or bleach-fixing processing and incorporating a compound represented by the general formula (I) described below or a salt thereof in a bath of the bleaching processing or bleach-fixing processing or in a prebath thereof.

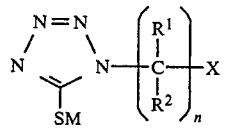

(I)

wherein $R^1$ and $R^2$, which may be the same or different, each represents a hydrogen atom or a lower alkyl group; X represents a $—NH^3R^4$ group, a —COOM group, a $—SO_3M$ group or a hydroxy group; $R^3$ and $R^4$, which may be the same or different, each represents a hydrogen atom or a substituted or unsubstituted alkyl group or $R^3$ and $R^4$ are bonded to each other to form a ring; M represents a cation; and n represents an integer of 1 to 5.

The method of the present invention does not produce poisonous materials which are harmful to the environment and provides an excellent high speed bleaching process without harming other photographic properties.

20 Claims, No Drawings

METHOD FOR PROCESSING COLOR PHOTOGRAPHIC LIGHT-SENSITIVE MATERIAL

FIELD OF THE INVENTION

The present invention relates to a method for the processing of an exposed silver halide color photographic light-sensitive material (hereinafter referred to as a color light-sensitive material) which comprises developing, bleaching, and fixing it (hereinafter referred to as a color photographic processing method), and, more particularly, to an improved bleaching process which accelerates the bleaching function thus shortening the processing time while providing sufficient bleaching, thus providing a color photographic image having good image quality.

BACKGROUND OF THE INVENTION

The fundamental steps of processing color light-sensitive materials generally include a color-developing step and a silver-removing step. That is, an exposed silver halide color photographic light-sensitive material is introduced into a color-developing step, wherein the silver halide is reduced with a color-developing agent to produce silver and the oxidized color developing agent in turn reacts with a color former to give a dye image. Subsequently, the color photographic material is introduced into a silver-removing step, wherein silver having been produced in the proceding step is oxidized with an oxidizing agent (usually called a bleaching agent), and dissolved away with a silver ion-complexing agent usually called a fixing agent. Therefore, only a dye image is formed in the thus processed photographic material. In addition to the above-described two fundamental steps of color development and silver removal, actual development processing involves auxiliary steps for maintaining the photographic and physical quality of the resulting image or for improving the preservability of the image. For example, there are illustrated a hardening bath for preventing the light-sensitive layer from being excessively softened during photographic processing, a stopping bath for effectively stopping the developing reaction, an image-stabilizing bath for stabilizing the image, and a layer-removing bath for removing the backing layer on the support.

The above-described silver removal may be conducted in two ways: one way uses two steps employing a bleaching bath and a fixing bath; and the other way is more simple and conducted in one step employing a bleach-fixing (or blixing) bath containing both a bleaching agent and a fixing agent for the purpose of accelerating the processing and eliminating work.

Ferricyanide and ferric chloride, which have heretofore been used as bleaching agents, are good bleaching agents due to their large oxidizing power. However, a bleaching solution or bleach-fixing solution containing ferricyanide can release poisonous cyanide by photolysis causing environmental pollution. Accordingly, the waste solution thereof must be made completely harmless in view of environmental pollution. A bleaching solution containing ferric chloride as a bleaching agent is not desirable because materials constituting vessels in which the solution is retained are liable to be corroded due to the extremely low pH and large oxidizing power of the solution. In addition, iron hydroxide is precipitated in an emulsion layer during the water-washing step provided after the bleaching step, resulting in stain formation.

On the other hand, potassium dichromate, quinones, copper salts, etc., which have been used as bleaching agents have weak oxidizing power and are difficult to handle.

In recent years, bleach processing using a ferric ion complex salt (e.g., aminopolycarboxylic acid-ferric ion complex salt, particularly iron (III) ethylenediaminetetraacetate complex salt) as a major component has mainly been employed in processing color photographic light-sensitive materials in view of acceleration and simplification of the bleaching step and the need to prevent environmental pollution.

However, ferric ion complex salts have a comparatively small oxidizing power and, therefore, have insufficient bleaching power. A bleaching or bleach-fixing solution containing the complex salt as a bleaching agent can attain some desirable objects when bleaching or bleach-fixing a low-speed silver halide color photographic light-sensitive material containing, for example, a silver chlorobromide emulsion as a major component. However, such a solution fails to fully remove silver due to insufficient bleaching power or requires a long time to bleach when processing a high-speed, spectrally sensitized silver halide color photographic light-sensitive material containing a silver chlorobromoiodide emulsion or silver bromoiodide emulsion as a major component, particularly color reversal light-sensitive materials for photographic use or color negative light-sensitive materials for photographic use comprising an emulsion containing larger amounts of silver.

Other known bleaching agents than ferric ion complex salts include persulfates. Persulfates are usually used in a bleaching solution together with a chloride. However, such a persulfate-containing bleaching solution has less bleaching power than ferric ion complex salts, thus requiring a substantially long period of time for bleaching.

As described above, bleaching agents which do not cause environmental pollution or corrode vessels and apparatuses have only a weak bleaching power. Hence, there has been a need to enhance the bleaching power of a bleaching or bleach-fixing solution containing a bleaching agent with a weak bleaching power, particularly a ferric ion complex salt or a persulfate.

In order to raise the bleaching power of a bleaching or bleach-fixing solution containing a ferric ion complex salt such as iron (III) ethylenediaminetetraacetate as a bleaching agent, it has been proposed to add various bleach accelerating agents to the processing bath.

Examples of such bleach accelerating agents include thiourea derivatives as described in Japanese Patent Publication No. 8506/70, U.S. Pat. No. 3,706,561, etc., selenourea derivatives as described in Japanese Patent Application (OPI) No. 280/71, five-membered ring mercapto compounds as described in British Pat. No. 1,138,842, and thiourea derivatives, thiazole derivatives, and thiadiazole derivatives as described in Swiss Pat. No. 336,257. Further, 5-mercaptotetrazoles as silver removal accelerating agents employed in a bleach-fixing solution are described in British Pat. No. 1,138,842. However, these compounds have a weak silver removal accelerating power and, therefore, have insufficient bleach accelerating effects, particularly on high-speed photographic light-sensitive materials. Thus, many of these bleach accelerating agents do not show a satisfactory bleach accelerating effect, or some of them lack stability in the processing solution although they have a good bleach accelerating effect. Therefore, they provide a processing solution having only a short effective life or which cannot be stored for a long time.

SUMMARY OF THE INVENTION

An object of the present invention is to provide a method for processing a color photographic material, which does not release strongly poisonous materials, which meets the requirement of preventing environmental pollution, and which has excellent bleaching speed.

Another object of the present invention is to provide a method involving a bleaching or bleach-fixing step in which enhanced bleaching power is attained without deteriorating other photographic properties using a bleaching agent having a weak bleaching power, in particular a ferric ion complex salt or a persulfate.

A further object of the present invention is to provide a bleaching process which uses a bleaching or bleach-fixing solution showing an increased bleaching speed and having good stability.

A still further object of the present invention is to provide a method which can quickly bleach or bleach-fix a color photographic light-sensitive material having high photographic speed.

Other objects of the present invention will become apparent from the following detailed description and examples.

These objects of the present invention can be attained by a method for processing a color photographic light-sensitive material by subjecting an exposed silver halide color photographic light-sensitive material to color development processing then to bleaching processing and fixing processing or to bleach-fixing processing, which process comprises using a ferric ion complex salt or a persulfate as a bleaching agent in the bleaching processing or bleach-fixing processing and incorporating a compound represented by the general formula (I) described below or a salt thereof in a bath of the bleaching processing or bleach-fixing processing or in a prebath thereof.

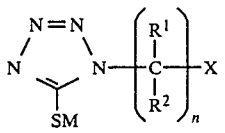

(I)

wherein $R^1$ and $R^2$, which may be the same or different, each represents a hydrogen atom or a lower alkyl group; X represents $NR^3R^4$ group, a —COOM group, a —$SO_3M$ group or a hydroxy group; $R^3$ and $R^4$, which may be the same or different, each represents a hydrogen atom or a substituted or unsubstituted alkyl group or $R^3$ and $R^4$ are bonded to each other to form a ring; M represents a cation; and n represents an integer of 1 to 5.

DETAILED DESCRIPTION OF THE INVENTION

The compounds represented by the general formula (I) are described in more detail below.

In the general formula (I), $R^1$ and $R^2$, which may be the same or different, each represents a hydrogen atom or a lower alkyl group (preferably an alkyl group having from 1 to 5 carbon atoms, for example, a methyl group, an ethyl group, etc.); X represents a —$NR^3R^4$ group, a —COOM group, a —$SO_3M$ group or a hydroxy group; $R^3$ and $R^4$, which may be the same or different, each represents a hydrogen atom or a substituted or unsubstituted alkyl group (the alkyl moiety having preferably from 1 to 5 carbon atoms and most preferably from 1 to 3 carbon atoms) or $R^3$ and $R^4$ are bonded to each other to form a ring (for example, a morpholine ring, a pyrolidine ring, a piperidine ring, etc.); M represents a cation (for example, $H^+$, $Na^+$, $K^+$, $Li^+$, $NH_4^+$, etc.); and n represents an integer of 1 to 5.

Of the compounds represented by the general formula (I), those wherein X represents a —$NR^3R^4$ group are preferably used in the present invention.

The substituted alkyl group represented by $R^3$ or $R^4$ includes an alkyl group substituted with an amino group, a —COOM group, a —$SO_3M$ group, a hydroxy group or an alkylsulfonyl group, etc. Specific examples of the alkyl groups represented by $R^3$ or $R^4$ include a methyl group, an ethyl group, a butyl group, an aminoethyl group, a carboxymethyl group, a sulfomethyl group, a hydroxyethyl group, an aminoethyl group, an alkylsulfonylethyl group, etc. In the formulae, M has the same meaning as defined above.

The methods for syntheses of the compounds represented by the general formula (I) described above are specifically described in Japanese Patent Application (OPI) Nos. 68568/76, 70763/76 and 50169/78, D. A. Berges, G. W. Chan, T. J. Polansky, J. J. Taggart, G. L. Dunn, *Journal of Heterocyclic Chemistry,* Vol. 15, pages 981 to 985 (1978). The compounds synthesis methods of which are not specifically described in the above-described literature references can be easily synthesized with reference to the synthesis methods described in these literature references.

Specific examples of the compounds or salts thereof represented by the general formula (I) are set forth below, but the present invention should not be construed as being limited thereto.

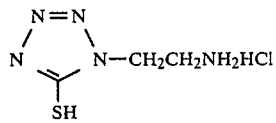

(1)

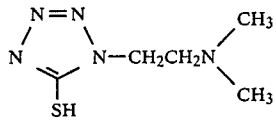

(2)

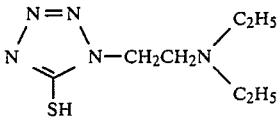

(3)

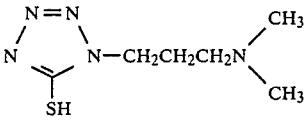

(4)

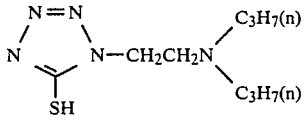

(5)

-continued (6)

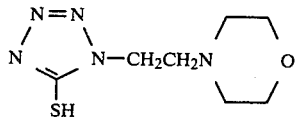

(7)

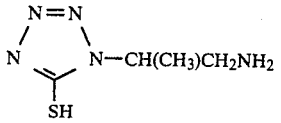

(8)

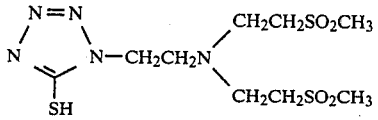

(9)

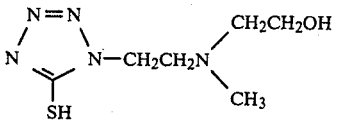

(10)

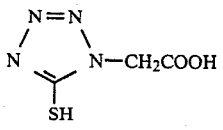

(11)

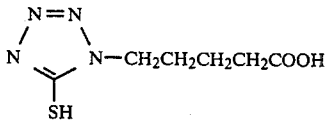

(12)

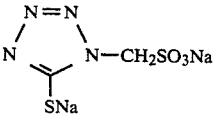

(13)

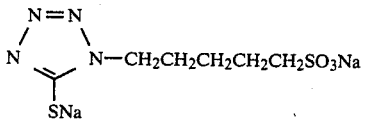

(14)

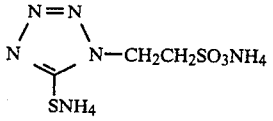

(15)

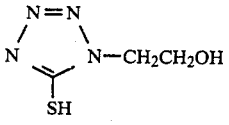

The compound of the above-described general formula to be used in the present invention as a bleach accelerating agent may be incorporated in a bleaching bath, a bleach-fixing bath, or a pre-bath thereof, or may be incorporated in both a bleaching or bleach-fixing bath and a pre-bath thereof. The amount of the compound of the present invention to be added to these solutions varies depending upon the kind of processing solution, kind of photographic material to be processed, processing temperature, time necessary for conducting intended processing, etc. However, an amount of $1\times10^{-5}$ to 1 mol per liter of a processing solution is suitable, with $1\times10^{-3}$ to $1\times10^{-1}$ mol being preferable. In general, however, when the amount added is small, only a small bleach accelerating effect is obtained, whereas when the amount is more than is necessary, a precipitate may be formed which stains the processed materials. Therefore, the best range is properly determined with consideration for individual cases.

The compound of the present invention is generally added to a processing solution by previously dissolving it in water, alkali, organic acid, or the like. If necessary, an organic solvent may be used for dissolving the compound without adversely affecting its bleach accelerating effect.

When incorporating the compound of the present invention in a pre-bath of a bleaching solution or bleach-fixing solution, the pre-bath may have various compositions. A pre-bath having the simplest composition is an aqueous solution prepared by merely dissolving the compound of the present invention in water. Aqueous solutions properly containing acids such as acetic acid, boric acid, etc., alkalis such as sodium hydroxide, etc., or salts such as sodium sulfite, sodium acetate, sodium thiosulfate, sodium borate, sodium carbonate, sodium bicarbonate, etc., are also usable as pre-baths with advantage. Pre-baths having any pH may be used with satisfactory effects on the present invention. However, too high of a pH may generate stain, and hence pre-baths having a pH of 9 or less are generally preferable. The pre-bath may further contain, if necessary, precipitation-preventing agents comprising various chelate compounds; hardeners comprising various compounds including alums or aldehydes; pH buffers; fixing agents for halides; antioxidants such as sulfites, hydroxylamine, hydrazine, etc.; swelling-preventing agents such as sodium sulfate, magnesium sulfate, etc.; surfactants; and the like.

Between the pre-bath and the bleaching or bleach-fixing bath may be provided, for example, a water-washing step, stopping step, stop-fixing step, or the like. In such cases, the addition of the compound of the present invention to the pre-bath will also bring about the same bleach accelerating effect. However, where the compound of the present invention is incorporated only in the pre-bath, the pre-bath is preferably provided immediately before a bleaching or bleach-fixing bath.

In the bleaching solution or bleach-fixing solution of the present invention, a bleaching agent with weak bleaching power is used. A ferric ion complex, one of the bleaching agents, is a complex of ferric ion and a chelating agent such as an aminopolycarboxylic acid, an aminopolyphosphonic acid or the salt thereof. Aminopolycarboxylic acid salts or aminopolyphosphonic acid salts are alkali metal salts, ammonium salts or water-soluble amine salts of aminopolycarboxylic acids or aminopolyphosphonic acids. The alkali metals include sodium, potassium, lithium, etc., and water-soluble amines include alkylamines (e.g., methylamine, diethylamine, triethylamine, butylamine, etc.), alicyclic amines (e.g., cyclohexylamine), arylamines (e.g., aniline,m-toluidine, etc.), and hetero cyclic amines (e.g., pyridine, morpholine, piperidine, etc.).

Typical examples of the chelating agents of these aminopolycarboxylic acids, aminopolyphosphonic acids, and the salts thereof are:

Ethylenediaminetetraacetic acid;

Disodium ethylenediaminetetraacetate;

Diammonium ethylenediaminetetraacetate;

Tetra(trimethylammonium)ethylenediaminetetraacetate;
Tetrapotassium ethylenediaminetetraacetate;
Tetrasodium ethylenediaminetetraacetate
Trisodium ethylenediaminetetraacetate;
Diethylenetriaminepentaacetic acid;
Pentasodium diethylenetriaminepentaacetate;
Ethylenediamine-N-(β-hydroxyethyl)-N,N',N'-triacetic acid;
Trisodium ethylenediamine-N-(β-hydroxyethyl)-N,N',N'-triacetate;
Triammonium ethylenediamine-N-(β-hydroxyethyl)-N,N',N'-triacetate;
Propylenediaminetetraacetic acid;
Disodium propylenediaminetetraacetate;
Nitrilotriacetic acid;
Trisodium nitrilotriacetate;
Cyclohexanediaminetetraacetic acid;
Disodium cyclohexanediaminetetraacetate;
Iminodiacetic acid;
Dihydroxyethylglycine;
Ethyl ether diaminetetraacetic acid;
Glycol ether diaminetetraacetic acid;
Ethylenediaminetetrapropionic acid;
Phenylenediaminetetraacetic acid;
1,3-Diaminopropanol-N,N,N',N'-tetramethylenephosphonic acid;
Ethylenediamine-N,N,N',N'-tetramethylenephosphonic acid;
1,3-Propylenediamine-N,N,N',N'-tetramethylenephosphonic acid; etc.

The present invention is not limited to the above-illustrated chelating agents.

The ferric ion complex salts may be used in the form of complex salt or may be formed in situ in a solution by using a ferric salt (e.g., ferric sulfate, ferric chloride, ferric nitrate, ferric ammonium sulfate or ferric phosphate) and a chelating agent (e.g., aminopolycarboxylic acid, aminopolyphosphonic acid or phosphonocarboxylic acid). When they are used in the form of a complex salt, they may be used alone or in combination of two or more. On the other hand, where a complex is formed in situ in a solution by using a ferric salt and a chelating agent, one, two or more ferric salts may be used. Further, one, two or more chelating agents may also be used. In every case, a chelating agent may be used in an amount more than is necessary for forming a ferric ion complex salt.

A bleaching or bleach-fixing solution containing the above-described ferric ion complex may further contain complexes of other metals than iron such as cobalt or copper or hydrogen peroxide.

Persulfates to be used in the bleaching or bleach-fixing solution of the present invention are alkali metal persulfates such as potassium persulfate, sodium persulfate, etc., and ammonium persulfate. The bleach accelerating agents of the present invention are, of course, effective for the persulfates, and show particularly remarkable effects on ferric ion complex salts.

The bleaching solution of the present invention can contain re-halogenating agents such as bromides (e.g., potassium bromide, sodium bromide, ammonium bromide, etc.), chlorides (e.g., potassium chloride, sodium chloride, ammonium chloride, etc.), and the like in addition to the bleaching agents such as ferric ion complex salts, etc. and the above-described compounds. Further, additives which have a pH-buffering ability such as inorganic acids, organic acids, or the salts thereof which are known to be used in ordinary bleaching solutions (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.) may be added.

The amount of bleaching agent is from 0.1 to 2 mols per liter of the bleaching solution, and the pH of the bleaching solution is desirably from 3.0 to 8.0, particularly from 4.0 to 7.0, when a ferric ion complex salt is used, and desirably from 1 to 5, when a persulfate is used.

On the other hand, when the composition according to the present invention is employed as a bleach-fixing agent, ordinary fixing agents, i.e., water-soluble, silver halide-dissolving agents such as thiosulfates (e.g., sodium thiosulfate, ammonium thiosulfate, ammonium sodium thiosulfate, potassium thiosulfate, etc.); thiocyanates (e.g., sodium thiocyanate, ammonium thiocyanate, potassium thiocyanate, etc.); thioether compounds (e.g., ethylenebisthioglycolic acid, 3,6-dithia-1,8-octanediol, etc.); and thioureas may be used alone or in a combination of two or more. In addition, special bleach-fixing agents comprising a combination of a fixing agent as described in Japanese Patent Application (OPI) No. 155354/80 and a large amount of a halide compound such as potassium iodide can be used as well.

In the bleach-fixing composition, the ferric ion complex salt is present in an amount of 0.1 to 2 mols and the amount of fixing agent is from 0.2 to 4 mols, per liter of the bleach-fixing solution.

A bleach-fixing solution can contain the afore-said additives to be added to the bleaching solution and preservatives such as sulfites (e.g., sodium sulfite, potassium sulfite, ammonium sulfite, etc.), hydroxylamine, hydrazine, aldehyde-bisulfite adducts (e.g., acetaldehydesodium bisulfite adduct), etc. Further, various fluorescent brightening agents, defoaming agents, surfactants, organic solvents (e.g., methanol), and known bleach-fixing accelerating agents (e.g., polyamine compounds as described in Japanese patent publication No. 8836/70 (corresponding to U.S. Pat. No. 3,578,457), thiourea derivatives as described in Japanese Patent Publication No. 8506/70 (corresponding to U.S. Pat. No. 3,617,283), iodies as described in German Pat. No. 1,127,715, polyethylene oxides as described in German Pat. No. 966,410, nitrogen-containing hetero cyclic compounds as described in German Pat. No. 1,290,812, and other thioureas) may be used. The pH of the bleach-fixing solution upon use is usually from 4.0 to 9.0, particularly preferably from 5.0 to 8.0.

The above-described bleaching agent or bleaching agent composition means a bleaching solution for a using solution or a replenishing solution and a bleach-fixing agent preparation for manufacturing a bleach solution for a using solution or a replenishing solution. When two or more liquid preparations are used, the pH of the liquid preparation containing a ferric ion complex salt can be further increased irrespective of the pH range as described above.

Primary aromatic amine color developing agents to be used in the present invention in a color-developing solution include a wide range of known ones for use in various color photographic processes. The developing agents include aminophenol derivatives and p-phenylenediamine derivatives. These compounds are generally used in the form of salts such as hydrochlorides or sulfates rather than in free form in view of stability. They are generally used in amount of from about 0.1 g to about 30 g, more preferably from about 1 g to about 15 g, per liter of color-developing solution.

The aminophenol-type developing agents include, for example, o-aminophenol, p-aminophenol, 5-amino-2-hydroxytoluene, 2-amino-3-hydroxytoluene, 2-hydroxy-3-amino-1,4-dimethylbenzene, etc.

Particularly useful primary aromatic amine type color-developing agents are N,N-dialkyl-p-phenylenediamine compounds wherein the alkyl group and the phenyl group may or may not be substituted. Of these, particularly useful compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-3-methylaniline p-toluenesulfonate, etc.

The alkaline color-developing solution to be used in the present invention can optionally contain, in addition to the above-described primary aromatic amine color-developing agent, various ingredients usually added to a color-developing solution, such as alkali agents (e.g., sodium hydroxide, sodium carbonate, potassium carbonate, etc.), alkali metal sulfites, alkali metal bisulfites, alkali metal thiocyanates, alkali metal halides, benzyl alcohol, water-softening agents, thickening agents, etc. The pH of the color-developing solution is usually 7 or above, most generally from about 9 to about 13.

The process of the present invention is applicable to color reversal processing. In the present invention, as a black-and-white developing solution to be used in this processing, a black-and-white first developing solution used for reversal processing of color photographic light-sensitive materials or that to be used for processing black-and-white photographic light-sensitive materials can be used. In addition, various well known additives generally added to a black-and-white developing solution can be incorporated in the solution.

Typical additives include developing agents such as 1-phenyl-3-pyrazolidone, metol, and hydroquinone; preservatives such as sulfites; accelerating agents comprising an alkali such as sodium hydroxide, sodium carbonate, or potassium carbonate; inorganic or organic inhibitors such as potassium bromide, 2-methylbenzimidazole, methylbenzothiazole, etc.; water-softening agents such as polyphosphoric acid salts; and slight amounts of development restrainers comprising an iodide or a mercapto compound.

Silver halide color photographic light-sensitive materials to be processed according to the present invention in the presence of the compound according to the present invention are known color photographic light-sensitive materials. The present invention is particularly advantageous for processing coupler-containing multilayer negative color photographic light-sensitive materials or color print photographic light-sensitive materials or for processing color photographic light-sensitive materials designed to be subjected to reversal color processing. In addition, color X-ray photographic light-sensitive materials, mono-layer special color photographic light-sensitive materials, and color photographic light-sensitive materials containing a black-and-white developing agent such as a 3-pyrazolidone as described in U.S. Pat. Nos. 2,751,297 and 3,902,905, Japanese patent application (OPI) Nos. 64339/81, 85748/81 and 85749/81, and a color developing agent precursor described in U.S. Pat. Nos. 2,478,400, 3,342,597, 3,342,599, 3,719,492 and 4,214,047, Japanese patent application (OPI) No. 135628/78 can be processed according to the present invention. Further, the processing may be conducted by allowing a coupler to exist in a developing solution.

In a photographic emulsion layer of color light-sensitive material used in the present invention, any of silver bromide, silver bromoiodide, silver iodo chlorobromide, silver chlorobromide, and silver chloride may be used as a silver halide.

The photographic emulsion to be used in the present invention can be prepared by the processes as described in P. Glafkides, *Chimie et Physique Photographique* (Paul Montel, 1967), G. F. Duffin, *Photographic Emulsion Chemistry* (The Focal Press, 1966), V. L. Zelikman et al., *Making and Coating Photographic Emulsion* (The Focal Press, 1964), etc.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc., may be allowed to coexist.

In the present invention, both negative emulsions forming surface latent images and direct reversal emulsions can be used. Examples of the latter emulsions include emulsions forming internal latent images and previously fogged direct reversal emulsions.

Silver halide emulsions may be used as so-called primitive emulsions without conducting chemical sensitization, but are usually chemically sensitized. Chemical sensitization can be conducted according to the processes described in the above-described books by Glafkides or Zelikman et al. or in H. Frieser, *Die Grundlagen der Photographischen Prozesse mit Silberhalogeniden* (Akademische Verlagsgesellschaft, 1968).

That is, sulfur sensitization using sulfur-containing compounds or active gelatin capable of reacting with silver ion, reduction sensitization using a reductive substance, and noble metal sensitization using compounds of noble metals such as gold can be employed alone or in combination. Examples of useful sulfur sensitizers include thiosulfates, thioureas, thiazoles, rhodanines, and other compounds. Examples of useful reduction sensitizers include stannous salts, amines, hydrazine derivatives, formamidinesulfinic acids and silane compounds. For noble metal sensitization, complexes of the group VIII metal such as platinum, iridium, palladium, etc., can be used as well as gold complexes.

Photographic emulsions may be spectrally sensitized with methine dyes or the like. Dyes to be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes, and complex merocyanine dyes.

In addition to a silver halide emulsion layer having the above-described light sensitivity may be provided a substantially light-insensitive, fine grain silver halide emulsion layer for the purpose of improving graininess or sharpness or for other purposes. Such a substantially light-insensitive fine grain emulsion layer can be provided on the light-sensitive silver halide emulsion layer or between the light-sensitive silver halide emulsion layer and a colloidal silver layer (yellow filter layer or antihalation layer).

The light-sensitive material according to the present invention may contain a polyalkylene oxide or its ether, ester and amine derivative, a thioether compound, a thiomorpholine, a quaternary ammonium salt compound, a urethane derivative, a urea derivative, an imidazole derivative, a 3-pyrazolidone, etc., for the purpose of increasing sensitivity or contrast or for accelerating development.

As binders for photographic emulsion layers or other constituent layers gelatin is advantageously employed, but other hydrophilic colloids may also be used.

Various compounds may be incorporated in the light-sensitive material according to the present invention as antifoggants or stabilizers. That is, many compounds known as antifoggants or stabilizers such as azoles (e.g., benzothiazolium salts, nitroindazoles, triazoles, benzotriazoles, benzimidazoles (particularly, nitro- or halogen-substituted derivatives), etc.); hetero cyclic mercapto compounds (e.g., mercaptothiazoles, mercaptobenzothiazoles, mercaptobenzimidazoles, mercaptothiadiazoles, mercaptotetrazoles (e.g., 1-phenyl-5-mercaptotetrazole), and mercaptpyrimidines); hetero cyclic mercapto compounds having a water-soluble group such as a carboxyl group or a sulfo group; thioketo compounds (e.g., oxazolinthione); azaindenes (e.g., tetraazaindenes (particularly 4-hydroxy-substituted (1,3,3a,7)-tetraazaindenes); benzenethiosulfonic acids; benzenesulfinic acids; etc., can be added.

The photographic light-sensitive material according to the present invention may contain an organic or inorganic hardener in its photographic emulsion layers or other constituent layers. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc., can be used alone or in combination.

The photographic light-sensitive material according to the present invention may contain in its photographic emulsion layers or other constituent layers various surfactants for various purposes such as improvement of coating properties, antistatic properties, slipping properties, emulsion dispersibility, anti-adhesion properties, and photographic properties (for example, development acceleration, increase in contrast, sensitization, etc.).

The light-sensitive material according to the present invention contains in its photographic emulsion layers color-forming couplers, that is, compounds capable of forming color by oxidative coupling with an aromatic primary amine developing agent (for example, a phenylenediamine derivative or an aminophenol derivative) in color development processing. For example, magenta couplers include 5-pyrazolone coupler, pyrazolobenzimidazole coupler, cyanoacetylcoumarone coupler, open-chain acylacetonitrile coupler, etc., yellow couplers include acylacetamide couplers (e.g., benzoylacetanilides, pivaloylacetanilides, etc.), and cyan couplers include naphthol couplers, phenol couplers, etc. Of these couplers, nondiffusible couplers having a hydrophobic group called ballast group are desirable. The couplers may be of either 4-equivalent type or 2-equivalent type. Colored couplers having color-correcting effects or couplers capable of releasing a development inhibitor upon development (so-called DIR couplers) may also be used. In addition to DIR couplers, DIR coupling compounds capable of forming a colorless coupling reaction product and releasing a development inhibitor and DIR redox compounds may also be incorporated.

Specific examples of useful magenta color forming couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German patent application (OLS) Nos. 2,408,665, 2,417,945, 2,418,959 and 2,424,467, Japanese patent publication No. 6031/65, Japanese patent application (OPI) Nos. 20826/76, 13041/75, 58922/77, 129538/74, 74027/74, 159336/75, 42121/77, 74028/74, 60233/75, 26541/76 and 55122/78, etc.

Specific examples of useful yellow color forming couplers are described in U.S. Pat. Nos. 2,875,057, 3,265,506, 3,408,194, 3,551,155, 3,582,322, 3,725,072 and 3,891,445, West German Pat. No. 1,547,868, West German patent application (OLS) Nos. 2,219,917, 2,261,361 and 2,414,006, British Pat. No. 1,425,020, Japanese patent publication No. 10783/76, Japanese patent application (OPI) Nos. 26133/72, 73147/73, 102636/76, 6341/75, 123342/75, 130442/75, 21827/76, 87650/75, 82424/77 and 115219/77, etc.

Specific examples of useful cyan color forming couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German patent application (OLS) Nos. 2,414,830 and 2,454,329, Japanese patent application (OPI) Nos. 59838/73, 26034/76, 5055/73, 146828/76, 69624/77 and 90932/77, etc.

Further, examples of useful couplers which provide color images having good fastness to heat and light and small decrease in color density even when they are processed with a bleaching solution having a small oxidizing power are described in U.S. Pat. Nos. 4,124,396, 4,327,173, 4,333,999 and 4,334,011, Japanese patent application (OPI) Nos. 155538/82 and 204545/82, etc.

Useful colored couplers are described in U.S. Pat. Nos. 3,476,560, 2,521,908 and 3,034,892, Japanese patent publication Nos. 2016/69, 22335/63, 11304/67 and 32461/69, Japanese patent application (OPI) Nos. 26034/76 and 42121/77, West German patent application (OLS) No. 2,418,959, etc.

Useful DIR couplers include o-aminoazo type DIR couplers as described in U.S. Pat. No. 3,148,062, thioether type DIR couplers as described in U.S. Pat. No. 3,227,554, 2-benzotriazole type DIR couplers as described in U.S. Pat. No. 3,617,291, 1-benzotriazolyl type DIR couplers as described in West German patent application (OLS) No. 2,414,006, Japanese patent application (OPI) Nos. 82424/77 (corresponding to U.S. Pat. No. 4,095,984) and 117627/77, nitrogen-containing hetero ring-substituted acetic acid ester type DIR couplers as described in Japanese patent application (OPI) Nos. 30591/75 and 82423/77, 2-equivalent type DIR cyan couplers as described in West German patent application (OLS) No. 2,527,652, Japanese patent application (OPI) Nos. 90932/77 (corresponding to U.S. Pat. No. 4,146,396) and 146828/76, malonic acid diamine type DIR couplers as described in Japanese patent application (OPI) No. 69624/77 (corresponding to U.S. Pat. No. 4,149,886), and the like.

Useful DIR coupling compounds which do not form a color include thioether type cyclic colorless DIR compounds as described in British Pat. No. 1,423,588, West German patent application (OLS) Nos. 2,405,442, 2,523,705, 2,529,350 and 2,448,063, U.S. Pat. No. 3,938,996, thioether type chain form colorless DIR compounds as described in U.S. Pat. Nos. 3,632,345 and 3,928,041, benzotriazolyl type colorless DIR compounds as described in Japanese patent application (OPI) Nos. 147716/75, 105819/76 (corresponding to British Pat. No. 1,547,377) and 67628/77 (corresponding to British Pat. No. 1,531,927), picolinium type DIR coupling compounds as described in Japanese patent application (OPI) No. 72433/76, and the like.

Useful DIR redox compounds include DIR hydroquinones as described in U.S. Pat. No. 3,639,417, West German patent application (OLS) No. 2,460,202, U.S. Pat. No. 3,297,445, DIR redox type couplers as described in Japanese patent application (OPI) No. 57828/77, and the like.

The light-sensitive material according to the present invention can contain a developing agent, including those described in *Research Disclosure,* Vol. 176, page 29 under the item of "Developing agents".

The light-sensitive material prepared according to the present invention may contain a dye in its photographic emulsion layers or other constituent layers as a filter dye or for various purposes such as prevention of irradiation. Examples of such dyes include those described in *Research Disclosure,* Vol. 176, pages 25 and 26 under the item of "Absorbing and filter dyes".

The light-sensitive material according to the present invention can further contain antistatic agents, plasticizers, matting agents, lubricants, ultraviolet ray-absorbing agents, fluorescent brightening agents, air fog-preventing agents, etc. including those described in *Research Disclosure,* Vol. 170, pages 22 to 27 (1978).

Silver halide emulsion layers and/or other constituent layers are coated on a support by a procedure such as described in *Research Disclosure,* Vol. 176, pages 27 to 28, under the item of "Coating procedures".

In the color photographic processing of the present invention, the use of the compound represented by the general formula (I) having excellent bleach accelerating effect makes it possible to attain sufficient silver removal in a short processing time even when a bleaching agent with weak bleaching power is used. Also the compounds of the general formula (I) according to the present invention do not adversely affect photographic properties such as color formation, sensitivity, and stain properties. Further, the compounds according to the present invention can stably exist in a processing bath for such a long time that troubles with control of the bath can be decreased.

The present invention will now be described in more detail with reference to the following examples, however, the present invention is not to be construed as being limited thereto.

EXAMPLE 1

On a triacetyl cellulose support provided with a subbing layer were coated in order the emulsion layers and subsidiary layers as described below.

First Layer: Low Sensitive Red-Sensitive Emulsion Layer 100 g of a cyan coupler, i.e., 2-(heptaflourobutyramido)-5-[2'-(2'',4''-di-tert-aminophenoxy)-butyramido]phenol was dissolved in 100 ml of tricresyl phosphate and 100 ml of ethyl acetate and stirred at a high speed together with 1 kg of a 10% aqueous gelatin solution to prepare an emulsion. Then, 500 g of the emulsion thus-obtained was mixed with 1 kg of a red-sensitive low-sensitive silver iodobromide emulsion (containing 70 g of silver and 60 g of gelatin, and having an iodide content of 3 mol%), and the resulting mixture was then coated at a dry thickness of 2$\mu$ (silver amount: 0.5 g/m$^2$).

Second Layer: High Sensitive Red-Sensitive Emulsion Layer 100 g of a cyan coupler, i.e., 2-(heptafluorobutyramido)-5-[2'-(2'',4''-di-tert-aminophenoxy)-butyramido]phenol was dissolved in 100 ml of tricresyl phosphate and 100 ml of ethyl acetate and stirred at a high speed together with 1 kg of a 10% aqueous gelatin solution to prepare an emulsion. Then, 1,000 g of the emulsion thus-obtained was mixed with 1 kg of a red-sensitive high-sensitive silver iodobromide emulsion (containing 70 g of silver and 60 g of gelatin, and having an iodide content of 3 mol%), and the resulting mixture was then coated at a dry thickness of 2$\mu$ (silver amount: 0.8 g/m$^2$).

Third Layer: Intermediate Layer 2,5-Di-tert-octylhydroquinone was dissolved in 100 ml of dibutyl phthalate and 100 ml of ethyl acetate, and stirred at a high speed together with 1 kg of a 10% aqueous gelatin solution to prepare an emulsion. Then, 1 kg of the emulsion thus-obtained was mixed with 1 kg of a 10% aqueous gelatin solution, and the resulting mixture was coated at a dry thickness of 1$\mu$.

Fourth Layer: Low Sensitive Green-Sensitive Emulsion Layer

An emulsion was prepared in the same manner as described in the preparation of the emulsion for the first layer except that a magenta coupler, i.e., 1-(2,4,6-trichlorophenyl)-3-[3-(2,4-di-tert-amylphenoxyacetamido)benzamido]-5-pyrazolone, was used in place of the cyan coupler. Then, 500 g of the emulsion thus-obtained was mixed with 1 kg of a green-sensitive, low-sensitive silver iodobromide emulsion (containing 70 g of silver and 60 g of gelatin, and having an iodine content of 2.5 mol%), and the resulting mixture was coated at a dry thickness of 2.0$\mu$ (silver amount: 0.7 g/m$^2$).

Fifth Layer: High Sensitive Green-Sensitive Emulsion Layer

An emulsion was prepared in the same manner as described in the preparation of the emulsion for the first layer except that a magenta coupler, i.e., 1-(2,4,6-trichlorophenyl)-3-[3-(2,4-di-tert-amylphenoxyacetamido)benzamido]-5-pyrazolone, was used in place of the cyan coupler. Then, 1,000 g of the emulsion thus-obtained was mixed with 1 kg of a green-sensitive, high-sensitive silver iodobromide emulsion (containing 70 g of silver and 60 g of gelatin, and having an iodine content of 2.5 mol%), and the resulting mixture was coated at a dry thickness of 2.0$\mu$ (silver amount: 0.7 g/m$^2$).

Sixth Layer: Intermediate Layer 1 kg of the emulsion used in the preparation of the third layer was mixed with 1 kg of a 10% aqueous gelatin solution and coated at a dry thickness of 1μ.

Seventh Layer: Yellow Filter Layer

An emulsion containing yellow colloidal silver was coated at a dry thickness of 1μ.

Eighth Layer: Low Sensitive Blue-Sensitive Emulsion Layer

An emulsion was prepared in the same manner as described in the preparation of the emulsion for the first layer except that a yellow coupler, i.e., α-pivaloyl-α-(1-benzyl-5-ethoxy-3-hydantoinyl)-2-chloro-5-dodecyloxycarbonyl-acetanilide, was used in place of the cyan coupler. Then, 1,000 g of the emulsion thus-obtained was mixed with 1 kg of a blue-sensitive, low-sensitive silver iodobromide emulsion (containing 70 g of silver and 60 g of gelatin and having an iodine content of 2.5 mol%), and the resulting mixture was coated at a dry thickness of 2.0μ (silver amount: 0.6 g/m$^2$).

Ninth Layer: High Sensitive Blue-Sensitive Emulsion Layer

An emulsion was prepared in the same manner as described in the preparation of the emulsion for the first layer except that a yellow coupler, i.e., α-pivaloyl-α-(1-benzyl-5-ethoxy-3-hydantoinyl-2-chloro-5-dodecyloxycarbonyl-acetanilide, was used in place of the cyan coupler. Then, 1,000 g of the emulsion thus-obtained was mixed with 1 kg of a blue-sensitive, high-sensitive silver iodobromide emulsion (containing 70 g of silver and 60 g of gelatin and having an iodine content of 2.5 mol%), and the resulting mixture was coated at a dry thickness of 2.0μ (silver amount: 1.0 g/m$^2$).

Tenth Layer: Second Protective Layer 1 kg of the emulsion used in the preparation of the third layer was mixed with 1 kg of a 10% aqueous gelatin solution and coated at a dry thickness of 2μ.

Eleventh Layer: First Protective Layer

A 10% aqueous gelatin solution containing a fine grain silver iodobromide emulsion which had not been chemically sensitized (grain size: 0.15μ; 1 mol% silver iodobromide emulsion) was coated so that the amount of silver coated was 0.3 g/m$^2$ and the dry thickness was 1μ.

The color reversal film thus-obtained was subjected to exposure in an exposure amount of 12.5 CMS to light having the color temperature of 4800° K. adjusted using a filter from a tungsten light source, and development processing according to the processing steps described below using various bleaching baths containing the compounds represented by the general formula (I).

| Processing Steps | Time | Temperature |
|---|---|---|
| First developing bath | 6 min | 38° C. |
| Washing with water | 2 min | " |
| Reversal bath | 2 min | " |
| Color developing bath | 6 min | " |
| Conditioning bath | 2 min | " |
| Bleaching bath | 5 min | " |
| Fixing bath | 4 min | " |
| Washing with water | 4 min | " |
| Stabiliz:ing bath | 1 min | ordinary |

-continued

| Processing Steps | Time | Temperature |
|---|---|---|
| | | temperature |

The composition of each processing solution used in the above-described processing is as follows.

| | |
|---|---|
| First Developing Bath | |
| Water | 700 ml |
| Sodium tetrapolyphosphate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1,000 ml (pH 10.1) |
| Reversal Bath | |
| Water | 700 ml |
| 6 Na Salt of nitrilo-N,N,N—trimethylenephosphonic acid | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1,000 ml |
| Color Developing Bath | |
| Water | 700 ml |
| Sodium tetrapolyphosphate | 2 g |
| Sodium sulfite | 7 g |
| Sodium tertiary phosphate (12 hydrate) | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—β-methanesulfonamidoethyl-3-methyl-4-aminoaniline sesquisulfate monohydrate | 11 g |
| Ethylenediamine | 3 g |
| Water to make | 1,000 ml |
| Conditioning Bath | |
| Water | 700 ml |
| Sodium sulfite | 12 g |
| Sodium ethylenediaminetetraacetate (dihydrate) | 8 g |
| Glacial acetic acid | 3 ml |
| Water to make | 1,000 ml |
| Bleaching Bath | |
| Water | 800 ml |
| Sodium ethylenediaminetetraacetate (dihydrate) | 2.0 g |
| Iron (III) ammonium ethylenediaminetetraacetate (dihydrate) | 120.0 g |
| Potassium bromide | 100.0 g |
| Water to make | 1,000 ml |
| Fixing Bath | |
| Water | 800 ml |
| Ammonium thiosulfate | 80.0 g |
| Sodium sulfite | 5.0 g |
| Sodium bisulfite | 5.0 g |
| Water to make | 1,000 ml |
| Stabilizing Bath | |
| Water | 800 ml |
| Formalin (37 wt %) | 5.0 ml |
| Fuji Driwel (trademark) | 5.0 ml |
| Water to make | 1,000 ml |

The silver amount remaining in the maximum density portion of each film sample having been subjected to the development processing as described above was measured according to X-ray fluorometric analysis. The results thus-obtained are shown in Table 1 below.

TABLE 1

| Sample | Bleach Accelerating Agent | Amount Added to Bleaching Bath | Amount of Remaining Silver ($\mu g/cm^2$) |
|---|---|---|---|
| 1 | Not added | none | 15 |
| 2 | Compound (1) | $5 \times 10^{-3}$ mol/l | 3.1 |
| 3 | Compound (2) | " | 3.0 |
| 4 | Compound (9) | " | 4.2 |
| 5 | Compound (10) | " | 6.7 |
| 6 | Compound (15) | " | 5.4 |

As is apparent from the results shown above, the films which were processed in the bleaching bath containing the compound according to the present invention are freed of silver to such degree that the remaining silver does not substantially matter, giving clear color images.

The compounds according to the present invention realized rapid development processing, causing less environmental pollution.

EXAMPLE 2

The same reversal processing as described in Example 1 was conducted except for adding the compound according to the present invention in an amount shown in Table 2 below to the conditioning bath in place of the bleaching bath of the processing steps in Example 1. The amount of silver remaining in the film samples was determined in the same manner as described in Example 1. The results thus-obtained are shown in Table 2 below.

TABLE 2

| Sample | Bleach Accelerating Agent | Amount Added to Bleaching Bath | Amount of Remaining Silver ($\mu g/cm^2$) |
|---|---|---|---|
| 7 | Not added | none | 17 |
| 8 | Compound (4) | $1 \times 10^{-2}$ mol/l | 2.9 |
| 9 | Compound (6) | " | 4.0 |
| 10 | Compound (12) | " | 6.3 |

As is apparent from the results shown above, the removal of silver is accelerated by the addition of the compound according to the present invention to the conditioning bath (i.e., a pre-bath of the bleaching bath) to the same degree as when added to the bleaching bath.

EXAMPLE 3

The same reversal processing as described in Example 1 was conducted except for omitting the conditioning bath, providing a bleach-fixing solution having the formulation described below in place of both the bleaching solution and the fixing solution, and adding Compound (2), (8) or (15) according to the present invention to the bleach-fixing solution (bleach-fixing time: 6 minutes) in an amount shown in Table 3 below. The amount of silver remaining in the film samples was determined in the same manner as described in Example 1. The results thus-obtained are shown in Table 3 below.

| Bleach-Fixing Bath | |
|---|---|
| Iron (III) ammonium ethylendiamine-tetraacetate dihydrate | 120.0 g |
| Disodium ethylenediaminetetraacetate | 5.0 g |
| Ammonium thiosulfate aqueous solution (70%) | 170.0 ml |
| Sodium sulfite | 10.0 g |
| Water to make | 1,000 ml (pH 6.5) |

TABLE 3

| Sample | Bleach Accelerating Agent | Amount Added to Bleaching Bath | Amount of Remaining Silver ($\mu g/cm^2$) |
|---|---|---|---|
| 11 | Not added | none | 110 |
| 12 | Compound (2) | $1 \times 10^{-2}$ mol/l | 3.5 |
| 13 | Compound (8) | " | 5.6 |
| 14 | Compound (15) | " | 8.8 |

As is apparent from the results shown above, the removal of silver is accelerated when the compound according to the present invention is added to the bleach-fixing solution.

EXAMPLE 4

On a polyethylene terephthalate film support were coated layers having the compositions set forth below to prepare a multilayer color photographic light-sensitive material.

First Layer: Antihalation Layer

A gelatin layer containing black colloidal silver

Second Layer: Intermediate Layer

A gelatin layer containing a dispersion of 2,5-ditert-octylhydroquinone

Third Layer: Low Sensitive Red-Sensitive Emulsion Layer

A silver iodobromide emulsion (iodide content: 5 mol%), silver coated amount: 1.6 g/m$^2$
Sensitizing Dye I—$6 \times 10^{-5}$ mol per mol of silver
Sensitizing Dye II—$1.5 \times 10^{-5}$ mol per mol of silver
Coupler EX-1—0.04 mol per mol of silver
Coupler EX-5—0.003 mol per mol of silver
Coupler EX-6—0.0006 mol per mol of silver Fourth Layer: High Sensitive Red-Sensitive Emulsion Layer A silver iodobromide emulsion (iodide content: 10 mol%), silver coated amount: 1.4 g/m$^2$
Sensitizing Dye I—$3 \times 10^{-5}$ mol per mol of silver
Sensitizing Dye II—$1.2 \times 10^{-5}$ mol per mol of silver
Coupler EX-2—0.02 mol per mol of silver
Coupler EX-5—0.0016 mol per mol of silver Fifth Layer: Intermediate Layer Same as the Second layer Sixth Layer: Low Sensitive Green-Sensitive Emulsion Layer A mono-dispersed silver iodobromide emulsion (iodide content: 4 mol%), silver coated amount: 1.2 g/m$^2$
Sensitizing Dye III—$3 \times 10^{-5}$ mol per mol of silver
Sensitizing Dye IV—$1 \times 10^{-5}$ mol per mol of silver
Coupler EX-4—0.05 mol per mol of silver
Coupler EX-8—0.008 mol per mol of silver
Coupler EX-6—0.0015 mol per mol of silver Seventh Layer: High Sensitive Green-Sensitive Emulsion Layer A silver iodobromide emulsion (iodide content: 10 mol%), silver coated amount: 1.3 g/m$^2$ Sensitizing Dye III—$2.5\times10^{-5}$ mol per mol of silver
Sensitizing Dye IV—$0.8\times10^{-5}$ mol per mol of silver
Coupler EX-3—0.017 mol per mol of silver
Coupler EX-8—0.003 mol per mol of silver
Coupler EX-10—0.003 mol per mol of silver Eighth Layer: Yellow Filter Layer A gelatin layer containing yellow colloidal silver and a dispersion of 2,5-di-tert-octylhydroquinone Ninth Layer: Low Sensitive Blue-Sensitive Emulsion Layer A silver iodobromide emulsion (iodide content: 6 mol%), silver coated amount: 0.7 g/m$^2$ Coupler EX-9—0.25 mol per mol of silver
Coupler EX-6—0.015 mol per mol of silver Tenth Layer: High Sensitive Blue-Sensitive Emulsion Layer A silver iodobromide emulsion (iodide content: 6 mol%), silver coated amount: 0.6 g/m$^2$ Coupler EX-9—0.06 mol per mol of silver Eleventh Layer: First Protective Layer A gelatin layer containing silver iodobromide (iodide content: 1 mol%, average particle size: 0.07$\mu$), silver coated amount: 0.5 g/m$^2$ and a dispersion of Ultraviolet Ray Absorbing Agent UV-1.

Twelfth Layer: Second Protective Layer

A gelatin layer containing trimethyl methacrylate particles (having a diameter of about 1.5$\mu$).

Gelatin Hardener H-1 and a surface active agent were incorporated into each of the layers in addition to the above-described components.

The compounds used for preparing the sample are as follows:

Sensitizing Dye I: Pyridinium salt of anhydro-5,5'-dichloro-3,3'-di($\gamma$-sulfopropyl)-9-ethylthiacarbocyanine hydroxide Sensitizing Dye II: Triethylamine salt of anhydro-9-ethyl-3,3'-di($\gamma$-sulfopropyl)-4,5,4',5'-dibenzothiacarbocyanine hydroxide Sensitizing Dye III: Sodium salt of anhydro-9-ethyl-5,5'-dichloro-3,3'-di($\gamma$-sulfopropyl)oxacarbocyanine Sensitizing Dye IV: Sodium salt of anhydro-5,6,5',6'-tetrachloro-1,1'-diethyl-3,3'-di{$\beta$-[$\beta$-($\gamma$-sulfopropoxy)ethoxy]ethyl}imidazolocarbocyanine hydroxide Coupler EX-1

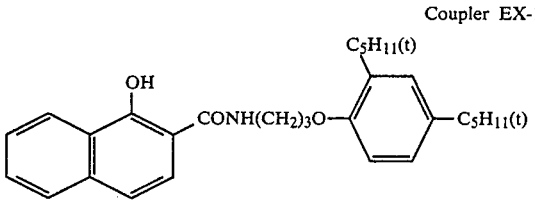

EX-2

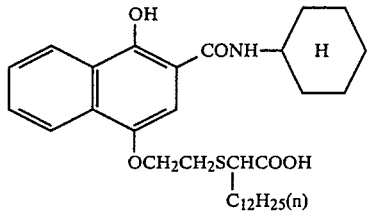

EX-3

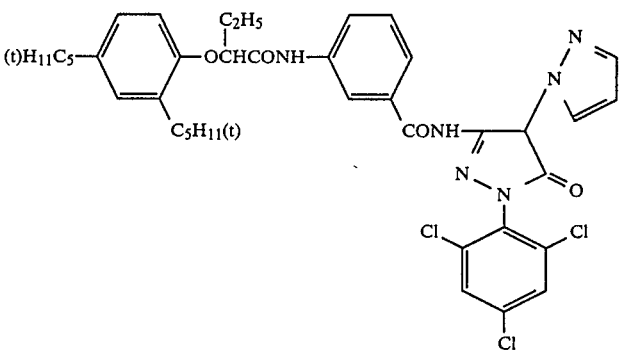

EX-4

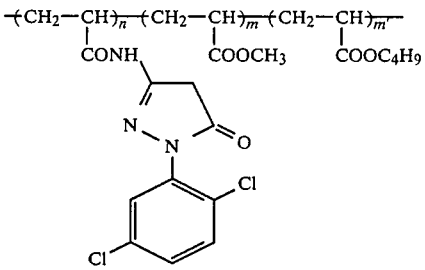

n/m + m' = 1,m/m' = 1
(wt ratio)
Molecular weight: about 40,000

-continued

EX-5

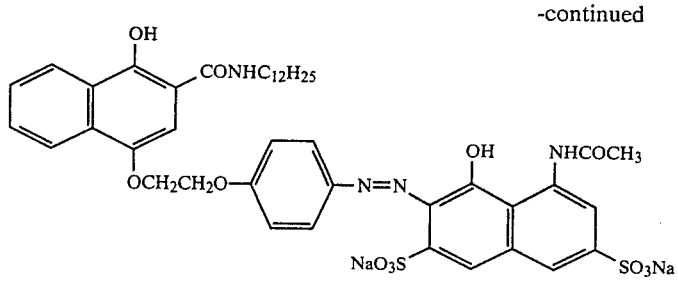

EX-6

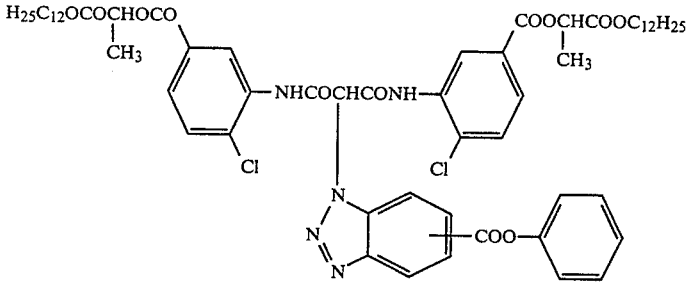

EX-8

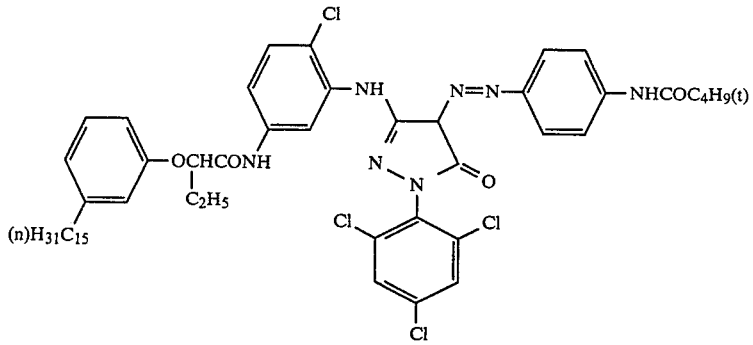

EX-9

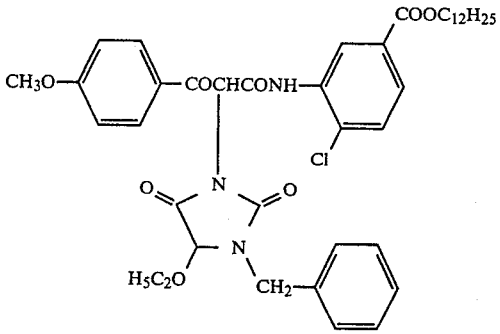

EX-10

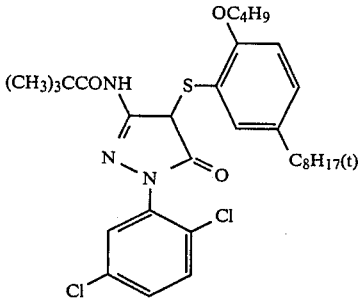

$H_2CHCSO_2CH_2CONH(CH_2)_2NHCOCH_2SO_2CH{=}CH_2$ H-1

UV-1

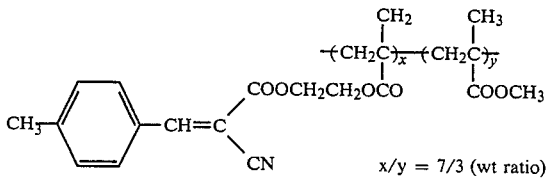

x/y = 7/3 (wt ratio)

The resulting photographic material was subjected to exposure to light in an exposure amount of 25 CMS using a tungsten light source and a filter to adjust the color temperature to 4,800° K., then development processing at 38° C. according to the following processing steps.

| Processing Steps | Time |
|---|---|
| Color development | 3 min and 15 sec |
| Bleaching | 4 min and 20 sec |
| Fixing | 4 min and 20 sec |
| Washing with water | 3 min and 15 sec |

-continued

| Processing Steps | Time |
|---|---|
| Stabilizing | 30 sec |

Composition of each processing solution used in the above-described processing is as follows.

| | |
|---|---|
| Color Developing Solution | |
| Trisodium nitrilotriacetate | 1.9 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water to make | 1,000 ml |
| | pH 10.0 |
| Bleaching Solution | |
| Iron (III) ammonium ethylenediamine-tetraacetate | 80.0 g |
| Disodium ethylenediaminetetraacetate | 8.0 g |
| Ammonium bromide | 150.0 g |
| Compound according to the present invention (shown in Table 4) | Amount shown in Table 4 |
| Water to make | 1,000 ml |
| | pH 6.0 |
| Fixing Solution | |
| Sodium tetrapolyphosphate | 2.0 g |
| Sodium sulfite | 4.0 g |
| Ammonium thiosulfate aqueous solutio (70%) | 175.0 ml |
| Sodium bisulfite | 4.6 g |
| Water to make | 1,000 ml |
| | pH 6.6 |
| Stabilizing Solution | |
| Formalin (40%) | 8.0 ml |
| Water to make | 1,000 ml |

Aside from the above-described development processing, the above-described development processing was conducted except for using the same bleaching bath as described above but not containing the compound according to the present invention.

Each film sample having been conducted development processing in the above-described manner was subjected to X-ray fluorometric analysis to determine the silver amount remaining in the maximum density portion of the sample. The results thus-obtained are shown in Table 4 below.

TABLE 4

| Sample | Bleach Accelerating Agent | Amount Added to Bleaching Bath | Amount of Remaining Silver (μg/cm²) |
|---|---|---|---|
| 15 | Not added | none | 11.5 |
| 16 | Compound (2) | $5 \times 10^{-3}$ mol/l | 0.8 |
| 17 | Compound (3) | " | 2.2 |
| 18 | Compound (7) | " | 3.7 |
| 19 | Compound (11) | " | 7.4 |

It is apparent from the results shown in Table 4 above that Samples 16 to 19 processed using the compound according to the present invention underwent remarkably accelerated removal of silver in comparison with the comparative Sample 15 processed without the compound according to the present invention.

EXAMPLE 5

The same processing as described in Example 4 was conducted except for providing a bleach-fixing solution having the formulation described below in place of both the bleaching solution and the fixing solution, and adding the compound according to the present invention (shown in Table 5) to the bleach-fixing solution (bleach-fixing time was 3 minutes and 15 seconds). The silver amount remaining in the film samples was determined in the same manner as described in Example 4. The results thus-obtained are shown in Table 5 below.

| | |
|---|---|
| Bleach-Fixing Solution | |
| Iron (III) ammonium ethylenediamine-tetraacetate dihydrate | 100.0 g |
| Disodium ethylenediaminetetraacetate dihydrate | 5.0 g |
| Sodium sulfite | 10.0 g |
| Ammonium thiosulfate aqueous solution (70%) | 170.0 ml |
| Water to make | 1,000 ml |
| | pH 6.9 |

TABLE 5

| Sample | Bleach Accelerating Agent | Amount Added to Bleaching Bath | Amount of Remaining Silver (μg/cm²) |
|---|---|---|---|
| 20 | Not added | none | 55.0 |
| 21 | Compound (2) | $1 \times 10^{-2}$ mol/l | 3.2 |
| 22 | Compound (5) | " | 3.2 |
| 23 | Compound (7) | " | 3.7 |
| 24 | Compound (9) | " | 4.3 |
| 25 | Compound (10) | " | 8.9 |
| 26 | Compound (14) | " | 9.7 |
| 27 | Compound (15) | " | 7.6 |
| 28 | Thiourea | " | 31.4 |
| 29 | 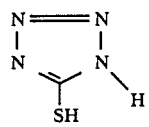 (Compound described in British Patent 1,138,842) | " | 45.5 |

It is apparent from the results shown in Table 5 above that the use of the compound according to the present invention (Samples 21 to 27) remarkably accelerated removal of silver in comparison with Sample 20 processed without the compound according to the present invention and with the use of known thiourea (Sample 28) and the known compound (Sample 29) both fallen outside the scope of the present invention, thus making it possible to rapidly bleach-fix high sensitive negative light-sensitive photographic materials.

In addition, dye images obtained by bleach-fixing using Compounds (2), (7), (9) and (15) according to the present invention were found to be equal to that obtained by Fuji Color Process CN-16 Processing (Fuji Photo Film Co., Ltd.) (color development: 3 min and 15 sec; bleaching: 6 min and 30 sec; washing with water: 2 min and 10 sec; fixing 4 min and 20 sec; washing with water: 3 min and 15 sec; stabilizing: 1 min and 5 sec; drying; processing temperature of each processing: 38.0±0.2° C.) in photographic properties such as color density, linear properties of characteristic curve, etc., and show good dye stability.

Then, bleach-fixing solution samples 21, 23, 25 and 27 were left for 2 weeks in a 40° C. thermostatic chamber to check for formation of a precipitate and deterioration of bleaching power. As a result, no troubles were found. Thus, the bleach-fixing solution containing the compound according to the present invention demonstrates excellent properties as a bleach-fixing solution.

EXAMPLE 6

On a polyethylene terephthalate film support having a subbing layer were coated, in sequence, the following emulsion solutions to prepare a color reversal photographic light-sensitive material.

First Layer (red-sensitive emulsion layer)

An emulsion solution prepared by adding, to 1,000 g of a silver iodobromide emulsion (silver iodide: 5 mol%) containing 10 g of silver halide and 5 g of gelatin per 100 g of the emulsion, 500 g of a gelatin solution containing a cyan coupler (C-1) emulsified and dispersed therein (molar ratio of silver to coupler=7:1), 50 ml of a 1% aqueous solution of a stabilizer (A-1), 50 ml of a 1% aqueous solution of a coating aid (T-1), and 20 ml of a 2% aqueous solution of a hardener (H-1) was coated at a dry thickness of 4μ.

Second Layer (intermediate layer)

A gelatin solution prepared by adding, to 1,000 g of a 5% gelatin aqueous solution, 100 g of a gelatin aqueous solution containing a color mixing preventing agent (A-2) emulsified and dispersed therein, 50 ml of a 1% aqueous solution of a coating aid (T-1), and 20 ml of a 2% aqueous solution of a hardener (H-1) was coated at a dry thickness of 1μ.

Third Layer (green-sensitive emulsion layer)

An emulsion solution prepared by adding, to 1,000 g of a silver iodobromide emulsion (silver iodide: 5 mol%) containing 10 g of silver halide and 5 g of gelatin per 100 g of the emulsion, 700 g of a gelatin solution containing a magenta coupler (C-2) emulsified and dispersed therein (molar ratio of silver to coupler=7:1), 50 ml of a 1% aqueous solution of a stabilizer (A-1), 50 ml of a 1% aqueous solution of a coating aid (T-1), and 20 ml of a 2% aqueous solution of a hardener (H-1) was coated at a dry thickness of 4μ.

Fourth Layer (yellow filter layer)

A solution prepared by adding 100 ml of a 1% aqueous solution of a coating aid (T-1) and 20 ml of a 2% aqueous solution of a hardener (H-1) to 1,000 g of a 5% gelatin aqueous solution containing dispersed therein colloidal silver was coated at a silver amount of 0.5 mg/100 $cm^2$.

Fifth Layer (blue-sensitive emulsion layer)

An emulsion solution prepared by adding, to 1,000 g of a silver iodobromide emulsion (silver iodide: 5 mol%) containing 10 g of silver halide and 5 g of gelatin per 100 g of emulsion, 500 g of a gelatin solution containing a yellow coupler (C-3) emulsified and dispersed therein (molar ratio of silver to coupler=7:1), 50 ml of a 1% aqueous solution of a stabilizer (A-1), 50 ml of a 1% aqueous solution of a coating aid (T-1), and 20 ml of a 2% aqueous solution of a hardener (H-1) was coated at a dry thickness of 4μ.

Sixth Layer (protective layer)

A gelatin solution prepared by adding 100 ml of a 1% aqueous solution of a coating agent (T-1) and 20 ml of a 1% aqueous solution of a hardener (H-1) to a 5% gelatin aqueous solution was coated in a dry thickness of 1μ.

C-1

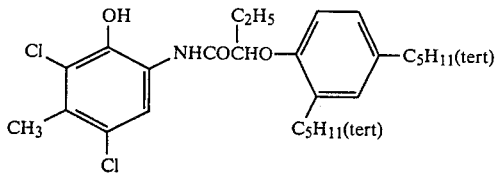

Emulsifying Procedure 75 g of cyan coupler (C-1) was dissolved in a mixture solution of 100 ml of dibutyl phthalate and 200 ml of ethyl acetate, and the resulting solution was emulsified in 600 g of a 10% gelatin aqueous solution together with a dispersing aid.

C-2

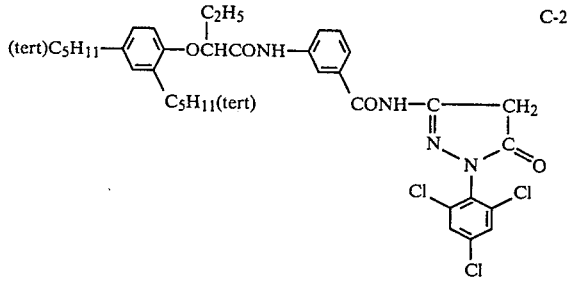

Emulsifying Procedure

Emulsification was conducted in the same manner as with cyan coupler (C-1) except for dissolving 75 g of magenta coupler (C-2) in place of cyan coupler (C-1).

C-3

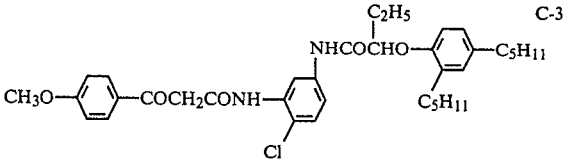

Emulsifying Procedure

Emulsification was conducted in the same manner as with cyan coupler (C-1) except for dissolving 90 g of yellow coupler (C-3) in place of cyan coupler (C-1).

A-1

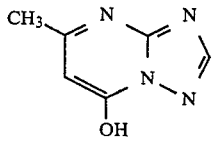

A-2

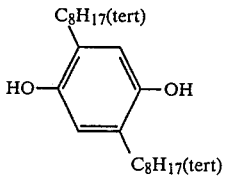

Emulsifying Procedure 100 g of color mixing preventing agent (A-2) was dissolved in a mixture solution of 200 ml of dibutyl phthalate and 200 ml of ethyl acetate, and the resulting solution was emulsified in 500 g of a 10% gelatin aqueous solution together with a dispersing aid.

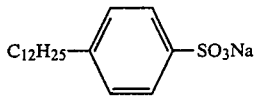

T-1

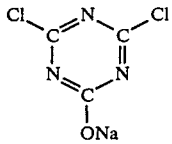

H-1

The thus-obtained color reversal film sample was subjected to exposure in an exposure amount of 12.5 CMS to light having the color temperature of 4800° K. adjusted using a filter from a tungsten light source, and development processing according to the following development processing steps using various pre-baths containing the compounds represented by the general formula (I) in an amount shown in Table 6 below, respectively.

| Processing Steps | Temperature | Time |
|---|---|---|
| First development | 43° C. | 2 min |
| Stopping | 40° C. | 20 sec |
| Washing with water | 40° C. | 40 sec |
| Color development | 46° C. | 2 min 15 sec |
| Pre-bath | 40° C. | 15 sec |
| Washing with water | 40° C. | 5 sec |
| Bleaching | 40° C. | 45 sec |
| Fixing | 40° C. | 40 sec |
| Washing with water | 40° C. | 25 sec |
| Stabilizing | 40° C. | 20 sec |

Composition of each processing solution used in the above-described processing is as follows.

| | |
|---|---|
| First Developing Solution | |
| Water | 800 ml |
| Sodium tetrametaphosphate | 2.0 g |
| Sodium bisulfite (anhydrous) | 8.00 g |
| Phenidone | 0.35 g |
| Sodium sulfite | 37.0 g |
| Hydroquinone | 5.50 g |
| Sodium carbonate | 28.2 g |
| Sodium thiocyanate | 1.38 g |
| Sodium bromide | 1.30 g |
| Potassium iodide (0.1% aq. soln.) | 13.0 ml |
| Water to make | 1,000 mL |
| | pH 9.90 |
| Stopping Solution | |
| Water | 800 ml |
| Glacial acetic acid | 30.0 ml |
| Sodium hydroxide | 1.65 g |
| Water to make | 1,000 ml |
| | pH 3.50 |
| Color Developing Solution | |
| Water | 800 ml |
| Sodium hexametaphosphate | 5.0 g |
| Benzyl alcohol | 4.50 ml |
| Sodium sulfite (anhydrous) | 7.50 g |
| Sodium tertiary phosphate (12 hydrate) | 36.0 g |
| Sodium bromide | 0.90 g |
| Potassium iodide (0.1% aq. soln.) | 90 ml |
| Sodium hydroxide | 3.25 g |
| Citrazinic acid | 1.50 g |
| N—Ethyl-N—β-methanesulfonamido-ethyl-3-methyl-4-aminoaniline sesquisulfate monohydrate | 11.0 g |
| Ethylenediamine | 3.00 g |
| tert-Butylaminoboran | 0.07 g |

-continued

| | |
|---|---|
| Water to make | 1,000 ml |
| | pH 11.65 |
| Pre-Bath | |
| Water | 800 ml |
| Sodium sulfite (anhydrous) | 12 g |
| Glacial acetic acid | 10 ml |
| Bleach accelerating agent (shown in Table 6) | $1 \times 10^{-2}$ mol |
| Water to make | 1,000 ml |
| | pH was adjusted to 3.5 |
| Bleaching Solution | |
| Water | 800 ml |
| Sodium persulfate | 60 g |
| Sodium chloride | 30 g |
| Phosphoric acid aqueous solution (85 wt %) | 11.8 ml |
| Sodium hydroxide | 6.4 g |
| β-aminopropionic acid | 2 g |
| Water to make | 1,000 ml |
| | pH 2.7 |
| Fixing Solution | |
| Water | 600 ml |
| Ammonium thiosulfate aqueous solution (58 wt %) | 169 ml |
| Sodium sulfite (anyhdrous) | 11.5 g |
| Disodium ethylenediaminetetraacetate | 0.5 g |
| Sodium acetate (anhydrous) | 12 g |
| Glacial acetic acid | 9 ml |
| Water to make | 1,000 ml |
| | pH 5.5 |
| Stabilizing Bath | |
| Water | 800 ml |
| Aqueous formalin 137.5 wt %) | 6.0 ml |
| Water to make | 1,000 ml |

Each film sample having been conducted the development processing in the above-described manner was subjected to X-ray fluorometric analysis to determine the silver amount remaining in the maximum density portion of the sample. The results thus-obtained are shown in Table 6 below.

TABLE 6

| Sample | Bleach Accelerating Agent | Amount Added to Bleaching Bath | Amount of Remaining Silver ($\mu g/cm^2$) |
|---|---|---|---|
| 30 | Not added | none | 450 |
| 31 | Compound (1) | $1 \times 10^{-2}$ mol/l | 3 |
| 32 | Compound (9) | " | 4 |
| 33 | Compound (10) | " | 9 |
| 34 | Compound (14) | " | 12 |
| 35 | Compound (15) | " | 8 |

It is apparent from the results shown in Table 6 above that the removal of silver is remarkably accelerated upon the addition of the compound according to the present invention to the pre-bath of the bleaching solution containing persulfate.

While the invention has been described in detail and with reference to specific embodiments thereof, it will be apparent to one skilled in the art that various changes and modifications can be made therein without departing from the spirit and scope thereof.

What is claimed is:

1. A method for processing a color photographic light-sensitive material by subjecting an exposed silver halide color photographic light-sensitive material to color development processing then to bleaching processing and fixing processing or to bleach-fixing processing, which process comprises using a ferric ion complex salt or a persulfate as a bleaching agent in the bleaching processing or bleach-fixing processing and incorporating a compound represented by the general formula (I) described below or a salt thereof in a bath of the bleaching processing or bleach-fixing processing or in a pre-bath thereof.

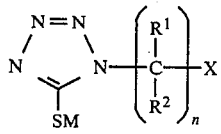

(I)

wherein $R^1$ and $R^2$, which may be the same or different, each represents a hydrogen atom or a lower alkyl group; X represents a $NR^3R^4$ group, a —COOM group, a $—SO_3M$ group or a hydroxy group; $R^3$ and $R^4$, which may be the same or different, each represents a hydrogen atom or a substituted or unsubstituted alkyl group or $R^3$ and $R^4$ are bonded to each other to form a ring; M represents a cation; and n represents an integer of 1 to 5.

2. A method for processing a color photographic light-sensitive material as claimed in claim 1, wherein the lower alkyl group represented by $R^1$ or $R^2$ is an alkyl group having from 1 to 5 carbon atoms.

3. A method for processing a color photographic light-sensitive material as claimed in claim 1, wherein the alkyl group represented by $R^3$ or $R^4$ is an alkyl group having from 1 to 5 carbon atoms.

4. A method for processing a color photographic light-sensitive material as claimed in claim 1, wherein X represents a $—NR^3R^4$ group.

5. A method for processing a color photographic light-sensitive material as claimed in claim 1, wherein a substituent for the substituted alkyl group represented by $R^3$ or $R^4$ is an amino group, a —COOM group, a $—SO_3M$ group, a hydroxy group or an alkylsulfonyl group, wherein M represents a cation.

6. A method for processing a color photographic light-sensitive material as claimed in claim 1, wherein the amount of the compound represented by the general formula (I) in a bleaching bath, a bleach-fixing bath or a pre-bath thereof is from $1\times10^{-5}$ to 1 mol per liter of a processing solution.

7. A method for processing a color photographic light-sensitive material as claimed in claim 1, wherein the compound represented by the general formula (I) is incorporated into a pre-bath of a bleaching bath or a bleach-fixing bath.

8. A method for processing a color photographic light-sensitive material as claimed in claim 6, wherein the pre-bath is an aqueous solution containing the compound represented by the general formula (I) and having a pH of 9 or less.

9. A method for processing a color photographic light-sensitive material as claimed in claim 1, wherein a bleaching agent used in a bleaching bath or bleach-fixing bath is a ferric ion complex salt.

10. A method for processing a color photographic light-sensitive material as claimed in claim 9, wherein the ferric ion complex salt is a complex of ferric ion and a chelating agent.

11. A method for processing a color photographic light-sensitive material as claimed in claim 10, wherein the chelating agent is an aminopolycarboxylic acid, an aminopolyphosphonic acid or a salt thereof.

12. A method for processing a color photographic light-sensitive material as claimed in claim 1, wherein a bleaching agent used in a bleaching bath or bleach-fixing bath is a persulfate.

13. A method for processing a color photographic light-sensitive material as claimed in claim 1, wherein the bleaching solution contains a re-halogenating agent.

14. A method for processing a color photographic light-sensitive material as claimed in claim 1, wherein the compound represented by the general formula (I) is incorporated into a bleaching solution.

15. A method for processing a color photographic light-sensitive material as claimed in claim 1, wherein the compound represented by the general formula (I) is incorporated into a bleach-fixing solution.

16. A method for processing a color photographic light-sensitive material as claimed in claim 1, wherein the bleach-fixing solution contains a ferric ion complex salt and a fixing agent.

17. A method for processing a color photographic light-sensitive material as claimed in claim 1, wherein the amount of the ferric ion complex salt is from 0.1 to 2 mols and the amount of the fixing agent is from 0.2 to 4 mols, per liter of the bleach-fixing solution.

18. A bleaching solution or a bleach-fixing solution comprises a ferric ion complex salt or a persulfate as a bleaching agent and a compound represented by the general formula (I) below or a salt thereof.

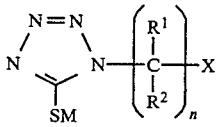

(I)

wherein $R^1$ and $R^2$, which may be the same or different, each represents a hydrogen atom or a lower alkyl group; X represents a $—NR^3R^4$ group, a —COOM group, a $—SO_3M$ group or a hydroxy group; $R^3$ and $R^4$, which may be the same or different, each represents a hydrogen atom or a substituted or unsubstituted alkyl group or $R^3$ and $R^4$ are bonded to each other to form a ring; M represents a cation; and n represents an integer of 1 to 5.

19. A bleaching solution or a bleach-fixing solution as claimed in claim 18, wherein the lower alkyl group represented by $R^1$ or $R^2$ is an alkyl group having from 1 to 5 carbon atoms; the alkyl group represented by $R^3$ or $R^4$ is an alkyl group having from 1 to 5 carbon atoms; X represents a $—NR^3R^4$ group; and a substituent for the substituted alkyl group represented by $R^3$ or $R^4$ is an amino group, a —COOM group, a $—SO_3M$ group, a hydroxy group or an alkylsulfonyl group, wherein M represents a cation.

20. A bleaching solution or a bleach-fixing solution as claimed in claim 18, wherein the amount of the compound represented by the general formula (I) is a bleaching solution or a bleach-fixing solution is from $1\times10^{-5}$ to 1 mol per liter of a processing solution.

* * * * *